US009149104B2

(12) United States Patent
Yoe et al.

(10) Patent No.: US 9,149,104 B2
(45) Date of Patent: Oct. 6, 2015

(54) NOZZLE FOR HAIR DRYER

(71) Applicants: Han Hian Yoe, Shenzhen (CN); Henry Yoe, Shenzhen (CN)

(72) Inventors: Han Hian Yoe, Shenzhen (CN); Henry Yoe, Shenzhen (CN)

( * ) Notice: Subject to any disclaimer, the term of this patent is extended or adjusted under 35 U.S.C. 154(b) by 384 days.

(21) Appl. No.: 13/746,595

(22) Filed: Jan. 22, 2013

(65) Prior Publication Data

US 2013/0133682 A1 May 30, 2013

Related U.S. Application Data

(63) Continuation-in-part of application No. 12/998,183, filed as application No. PCT/CN2010/071083 on Mar. 16, 2010, now abandoned.

(30) Foreign Application Priority Data

Mar. 24, 2009 (CN) ..... 2009 2 0135832 U

(51) Int. Cl.

| | |
|---|---|
| ***B05B 1/14*** | (2006.01) |
| ***B05B 1/24*** | (2006.01) |
| ***B05B 1/18*** | (2006.01) |
| ***A45D 20/00*** | (2006.01) |
| ***A45D 20/12*** | (2006.01) |

(52) U.S. Cl.

CPC ..... *A45D 20/00* (2013.01); *A45D 20/124* (2013.01)

(58) Field of Classification Search

CPC ..... A45D 20/124; A45D 20/00; A45D 20/12; A45D 20/122

USPC ..... 239/590.5, 134, 128, 135, 548, 556, 239/557, 567; 241/30, 100; 222/185.1; 132/227; 34/97, 98

See application file for complete search history.

(56) References Cited

U.S. PATENT DOCUMENTS

| | | | | | |
|---|---|---|---|---|---|
| 2,603,062 | A | * | 7/1952 | Weiler et al. | 239/265.43 |
| 3,503,138 | A | * | 3/1970 | Haeselich et al. | 34/99 |
| 3,645,007 | A | * | 2/1972 | Scott | 34/60 |
| 3,797,752 | A | * | 3/1974 | Cercone | 239/443 |
| 4,295,283 | A | * | 10/1981 | Tomaro | 34/97 |
| 4,602,146 | A | * | 7/1986 | Barns et al. | 392/384 |
| 5,148,512 | A | * | 9/1992 | Owens | 392/383 |
| 5,157,757 | A | * | 10/1992 | McDougall | 392/383 |
| 5,598,640 | A | * | 2/1997 | Schepisi | 34/97 |
| 5,661,910 | A | * | 9/1997 | Schepisi | 34/97 |
| D396,127 | S | * | 7/1998 | Schepisi | D28/18 |
| 5,842,286 | A | * | 12/1998 | Cantor | 34/96 |
| 6,038,782 | A | * | 3/2000 | Schepisi | 34/97 |
| 6,094,837 | A | * | 8/2000 | Cantor | 34/97 |
| 6,188,837 | B1 | * | 2/2001 | Kwan | 392/385 |

(Continued)

*Primary Examiner* — Jason Boeckmann
*Assistant Examiner* — Steven M Cernoch
(74) *Attorney, Agent, or Firm* — Novoclaims Patent Services LLC; Mei Lin Wong

(57) ABSTRACT

A hair dryer includes a main dryer unit having a dryer outlet and a nozzle which is mounted on the main dryer unit. The nozzle includes a nozzle body and a rotational body. The nozzle body has a first end portion, a second end portion, and an engagement structure provided on the first end portion and is arranged for connecting to the air outlet of the hair dryer. The rotational body has an air-flowing channel longitudinally extended along an axis of the rotational body, an outer rotational surface, and a plurality of through air outlets provided on the outer rotational surface and is communicated with the air-flowing channel, wherein the rotational body is mounted at the second end portion of the nozzle body for allowing hair to be curled on the rotational surface and dried by air blowing out of the air outlets.

4 Claims, 6 Drawing Sheets

(56) References Cited

U.S. PATENT DOCUMENTS 6,922,909 B2 * 8/2005 Andrew et al. ..... 34/96
6,966,125 B2 * 11/2005 Rago et al. ..... 34/283
7,634,177 B2 * 12/2009 Cheng ..... 392/489
7,716,849 B1 * 5/2010 Hicks ..... 34/104

* cited by examiner

NOZZLE FOR HAIR DRYER

CROSS REFERENCE OF RELATED APPLICATION

This is a Continuation-In-Part application of a non-provisional application having an application Ser. No. 12/998,183, and a filing date of Mar. 22, 2011, which is a 371 national phase application of an international application number PCT/CN2010/071083 and filing date Mar. 16, 2010, which claimed priority of foreign application number 200920135832.9 and filing date Mar. 24, 2009 in CHINA. The contents of these specifications, including any intervening amendments thereto, are incorporated herein by reference.

BACKGROUND OF THE PRESENT INVENTION

1. Field of Invention

The present invention relates to a tool for hairstyles design, and more particularly to a nozzle unit for a hair dryer.

2. Description of Related Arts

Nowadays, people usually use towels to dry wet hair after washing their hair and then leave their hair to dry naturally in the air. Some people may speed up the drying process of their wet hair through the use of hair dryers to blow their wet or damp hair. Accordingly, hair dryers have been developed as a very important tool for modeling hairstyle designs in our daily lives. Because a temperature of the blowing air coming out from the hair dryer is adjustable, the use of hair dryer can be broadened to meet different needs. However, a conventional hair dryer usually includes a hair dryer body and a nozzle connected to the hair dryer body. The nozzle usually has a flattened and elongated opening or a circular opening serving as the air outlet for the hair dryer. This design is not only unsatisfactory in providing a speedy drying performance but also inconvenient for use. In addition, this kind of nozzles can only provide one single function.

SUMMARY OF THE PRESENT INVENTION

The invention is advantageous in that it provides a nozzle for hair dryer which is adapted for use with a hair dryer so as to provide quick drying performance and hair style curling function at the same time.

Additional advantages and features of the invention will become apparent from the description which follows, and may be realized by means of the instrumentalities and combinations particular point out in the appended claims.

In order to accomplish the above objects, the present invention provides a hair dryer, comprising:

a main dryer unit having an air outlet; and a nozzle which is mounted on said main dryer unit, and comprises:

a nozzle body having a first end portion, a second end portion, and an engagement structure provided on said first end portion and is arranged for connecting to said air outlet of the hair dryer; and a rotational body having an air-flowing channel longitudinally extended along an axis of said rotational body, an outer rotational surface, and a plurality of through air outlets provided on said outer rotational surface and is communicated with said air-flowing channel, wherein said rotational body is mounted at said second end portion of said nozzle body for allowing hair to be curled on said rotational surface and dried by air blowing out of said air outlets so as to form a predetermined curling style for said hair.

DETAILED DESCRIPTION OF THE PREFERRED EMBODIMENT

The nozzle for hair dryer according to the preferred embodiment of the present invention is further described in the following.

Figure 1:
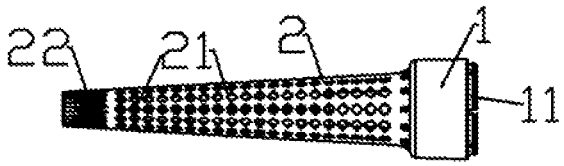
FIG. 1 is an illustration of a nozzle for hair dryer according to a preferred embodiment of the present invention.
Figure 2:
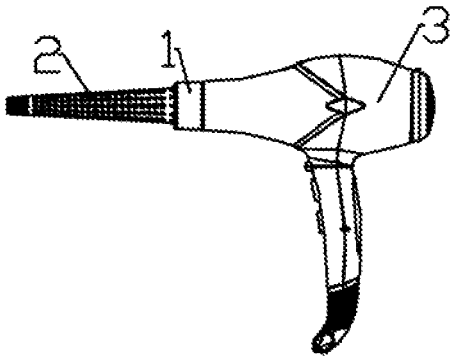
FIG. 2 is an illustration of a nozzle for hair dryer which is connected to a hair dryer according to the above preferred embodiment of the present invention.
Figure 3:
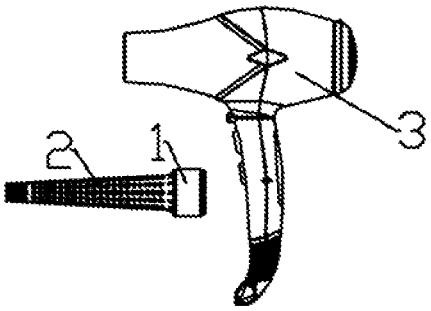
FIG. 3 is an illustration of a nozzle for hair dryer and a hair dryer according to the above preferred embodiment of the present invention.
Figure 4:
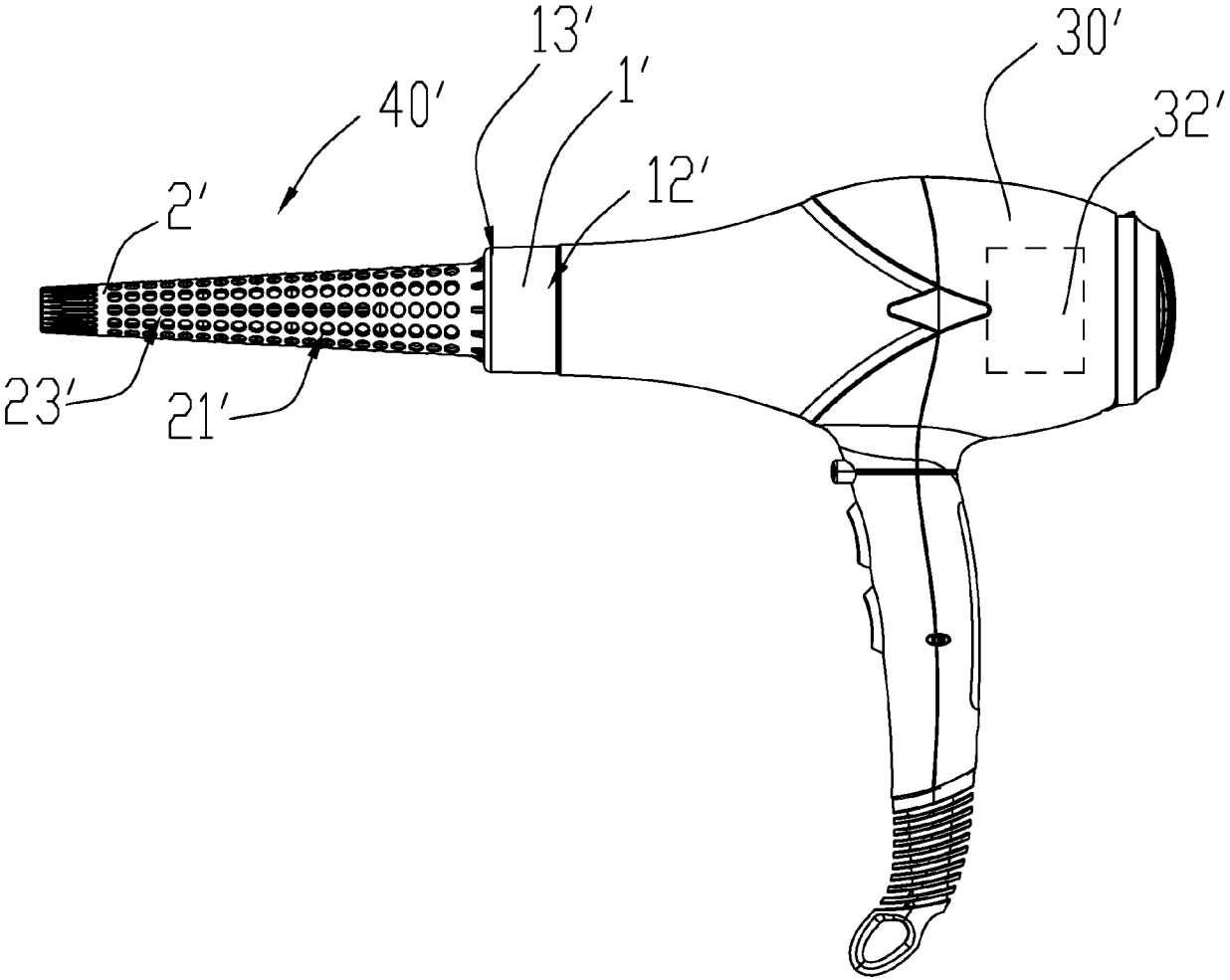
FIG. 4 is a side view of the hair dryer according to a second preferred embodiment of the present invention.
Figure 5:
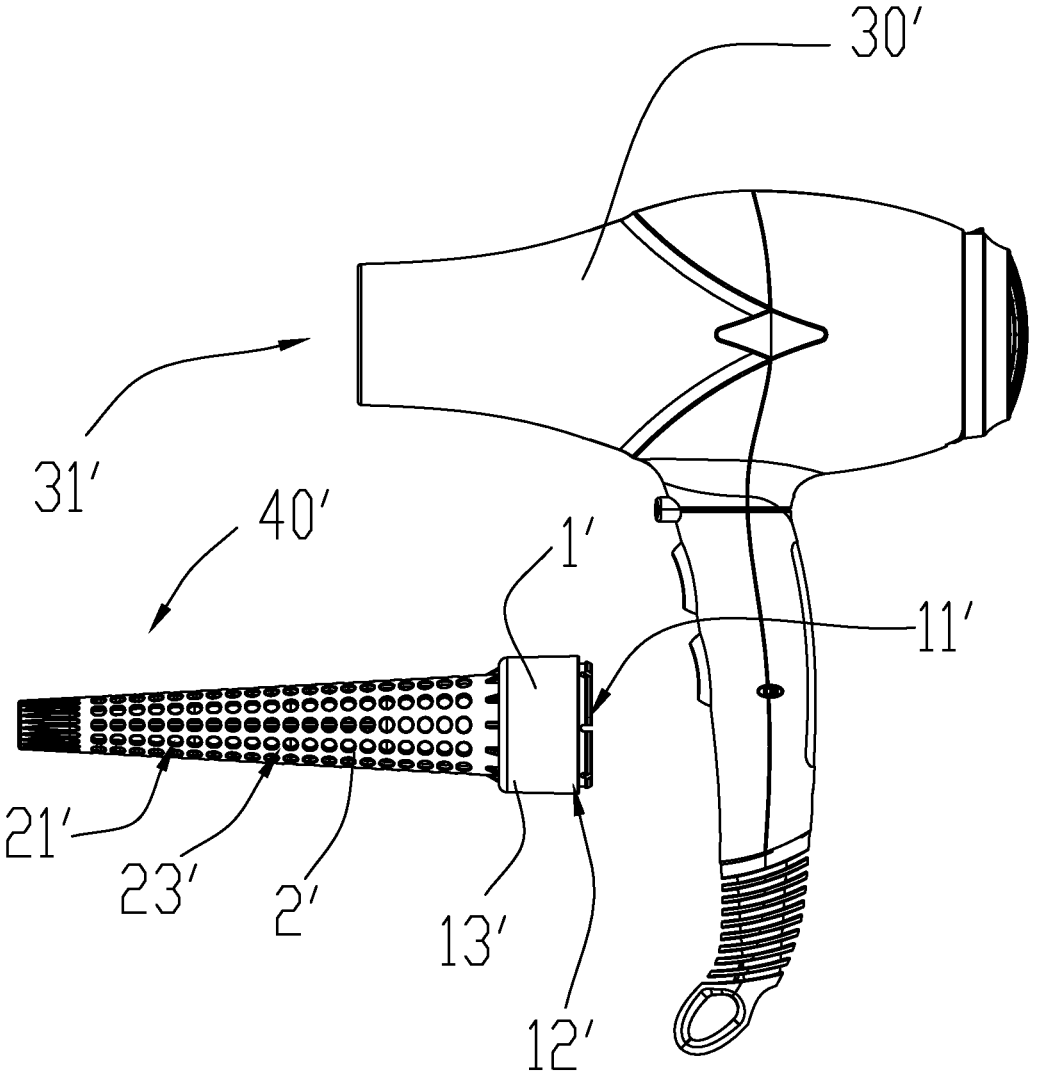
FIG. 5 is a schematic diagram of the hair dryer according to the second preferred embodiment of the present invention.
Figure 6:
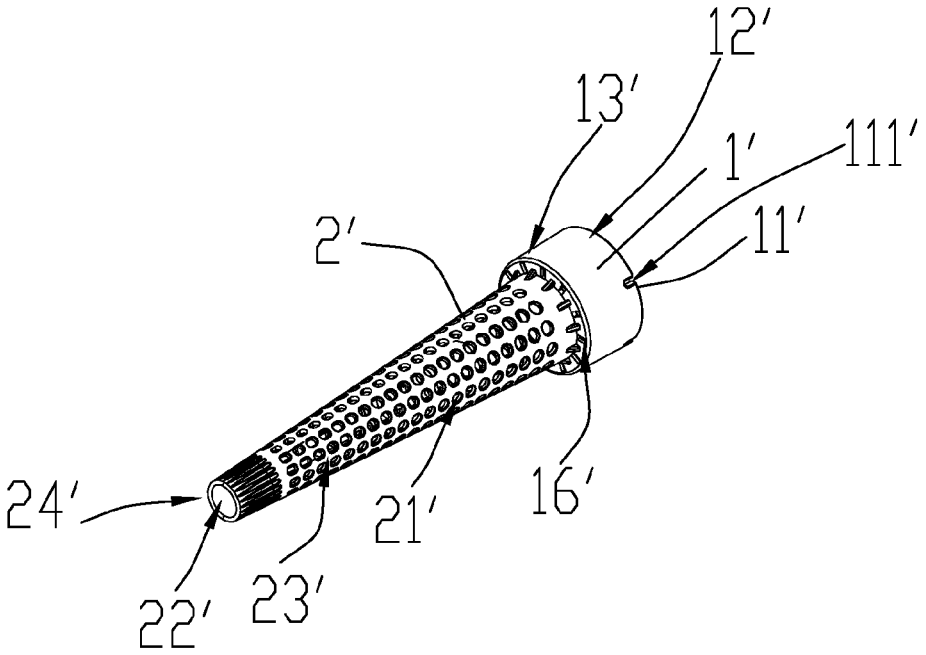
FIG. 6 is a perspective view of a nozzle of the hair dryer according to the second preferred embodiment of the present invention.
Figure 7:
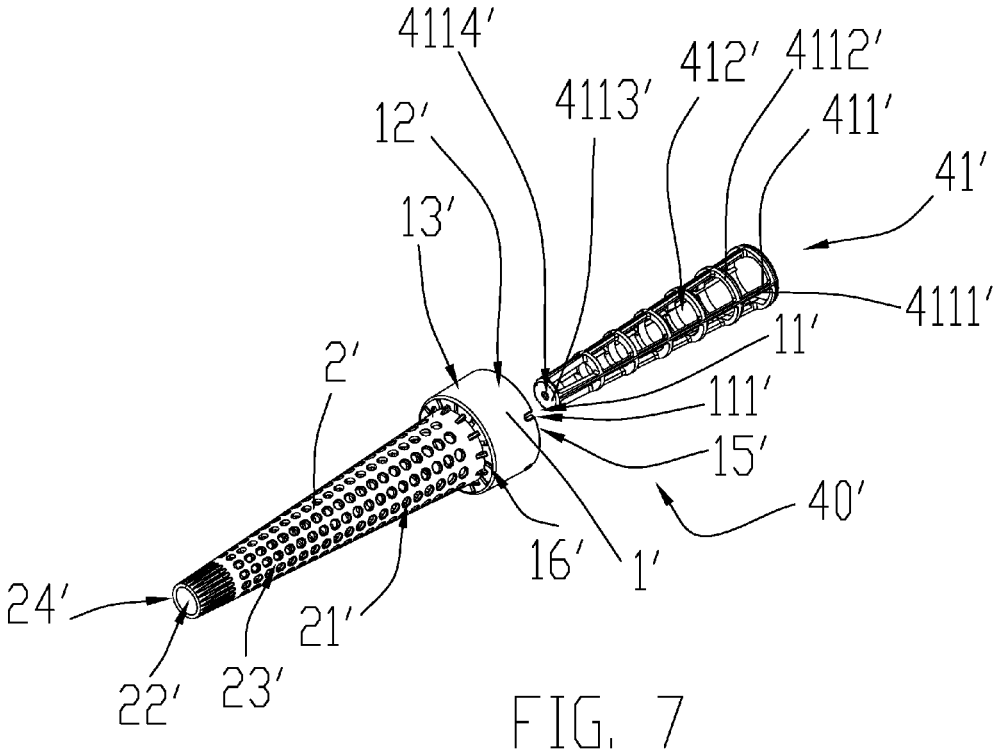
FIG. 7 is an exploded perspective view of the nozzle of the hair dryer according to the second preferred embodiment of the present invention.
Figure 8:
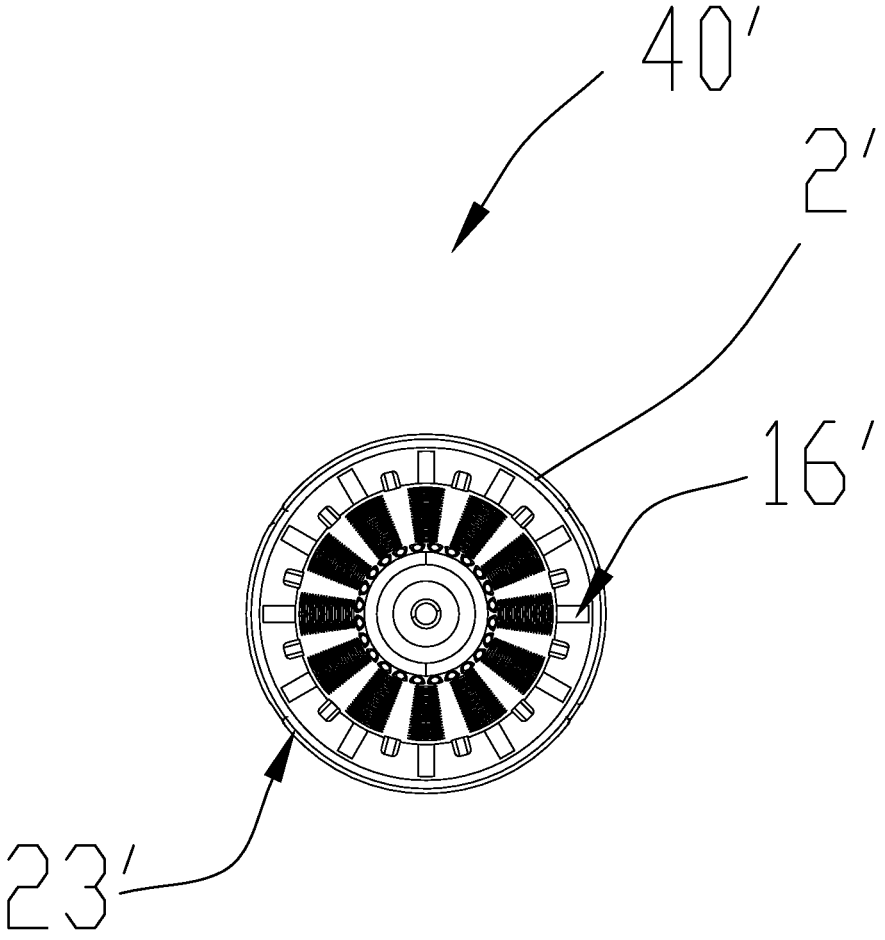
FIG. 8 is a front view of the nozzle of the hair dryer according to the second preferred embodiment of the present invention.

Referring to FIGS. 1 to 3 of the drawings, a nozzle for hair dryer according to the preferred embodiment of the present invention comprises a nozzle body 1 defining two end portions, namely a first end portion and a second end portion, an engagement structure 11 provided on the first end portion of the nozzle body which is arranged for connecting to a dryer outlet of the hair dryer such that the nozzle body 1 is securely and fittingly connected to the hair dryer, and a rotational body 2 provided on the second end portion of the nozzle body 1 in such a manner that the rotational body 2 is securely supported through the engagement structure 11 of the nozzle body 1. The rotational body 2 is capable of guiding and controlling an air flow from the hair dryer.

The rotational body 2 has an air-flowing channel longitudinally extended along an axis of the rotational body 2 such that air which is first flowing from the dryer outlet of the hair dryer is guided to flow to the air-flowing channel of the rotational body 2 while the rotational body 2 is securely supported through the nozzle body 1. The rotational body 2 has a rotational surface having a plurality of air outlets 21 through which the air-flowing channel of the rotational body 2 is communicated to, thereby air flowing from the air-flowing channel of the rotational body 2 is guided to penetrate through the air outlets 21.

Moreover, the rotational body 2 has a truncated cone-shaped structure in which the rotational surface is provided thereon and the plurality of air outlets 21 is co-axially and evenly provided along the axis of the rotational body 2 in such a manner that the air outlets 21 are systemically and evenly aligned on the rotational surface and are circumferential provided on the rotational body 2. The air outlet 21 is a circular opening through which air from the air-flowing channel is capable of being guided to flow at a direction which is perpendicular to the circular opening of the air outlet 21.

The rotational body 2 further defines an end portion having a plurality of air outlets 22 at the end portion, wherein the air outlets 22 at the end portion are elongated openings evenly and spacedly provided at the end portion and are circumferential provided along the longitudinal axis on the rotational body 2. On the other hand, the engagement arrangement 11 of the nozzle body 1 is a ring-shaped engaging groove in which a plurality of indented holes is defined so as to facilitate the attachment of the nozzle body 1 to the hair dryer.

Referring to FIG. 3 to FIG. 8 of the drawings, a hair dryer according to a second preferred embodiment of the present invention is illustrated, in which the hair dryer comprises a main dryer unit 30' having a dryer outlet 31', and a nozzle 40'.

The nozzle 40' is mounted on the main dryer unit 30', and comprises a nozzle body 1' and a rotational body 2'. The nozzle body 1' has a first end portion 12', a second end portion 13', and an engagement structure 11' which is provided on the first end portion 12' and is arranged for connecting to the air outlet 31' of the hair dryer 30'.

The rotational body 2' has an air-flowing channel 22' extended along a longitudinal axis of the rotational body 2', an outer rotational surface 23', and a plurality of through air outlets 21' provided on the outer rotational surface 23' and is communicated with the air-flowing channel 22', wherein the rotational body 2' is rotatably mounted at the second end portion 13' of the nozzle body 1' for allowing hair to be curled on the rotational surface 23' and dried by the air blowing out of the air outlets 21' so as to form a predetermined curling style for the hair. Note that the nozzle 1' further has a blowing cavity 15' formed therein and is arranged to communicate the air-flowing channel 22' with the dryer outlet 31' of the main dryer unit 30' so that the air coming from the dryer outlet 31' is capable of reaching the air-flowing channel 22' through the blowing cavity 15'.

The rotational body 2' further has a through axial outlet 24' formed at a distal end thereof and is communicated to the air-flowing channel 22', wherein air flowing into the air-flowing channel 22' may exit the air-flowing channel 22' through the axial outlet 24'.

According to the second preferred embodiment of the present invention, the main dryer unit 30' comprises a fan assembly 32' provided therein for generating a flow of air toward an exterior of the main dryer unit 30' through the dryer outlet 31'. The air blown out through the dryer outlet 31' is arranged to enter the nozzle 40' for controllably delivering to the user's hair.

The nozzle body 1' is circular in cross sectional shape and is connected between the main dryer unit 30' and the rotational body 2'. In other words, the rotational body 2' is extended from the second end portion 13' of the nozzle body 1' and is securely supported by the nozzle body 1' and the main dryer unit 30' through the engagement structure 11'. The rotational body 2' is capable of guiding and controlling the air flowing out from the main dryer unit 30'.

On the other hand, the rotational body 2' has a circular cross sectional shape and has a diameter gradually decreasing from the nozzle body 1' toward a distal end of the rotational body 2'. In other words, the rotational body 2' has a truncated cone shape or a tapered shape for curling the user's hair. In other words, the rotational body 2' tapers from a proximal end thereof to a distal end of the rotational body 2'.

As mentioned earlier, the rotational body 2' has the rotational surface 23' and the air outlets 21' through which the air-flowing channel 22' of the rotational body 2' is communicated to. Thus, air flowing from the air-flowing channel 22' of the rotational body 2' is guided to penetrate through the air outlets 21' and reach the user's hair. It is worth mentioning that the rotational surface 23' is arranged to accommodate and curl the user's hair so that when wet or damp hair are dried by the air blowing out from the air outlets 21', the hair will form a predetermined hairstyle as guided by the radius of curvature of the rotational surface 23'.

Furthermore, the air outlets 21' are spacedly and evenly provided on the rotational surface 23'. In this second preferred embodiment, each of the air outlets 21' is circular in shape and that the air from the air-flowing channel 22' is guided to flow through the air outlets 21' at a direction which is perpendicular to the circular opening of the air outlet 21.

As shown in FIG. 4 to FIG. 7 of the drawings, a largest diameter of the rotational body 2' is smaller than a diameter of the second end portion 13' of the nozzle body 1' to define a shoulder 14' formed between the rotational body 2' and the nozzle body 1', wherein the nozzle body 1' further has a plurality of through ventilating slots 16' spacedly formed on the shoulder 14' of the nozzle body 1' for allowing a predetermined amount of air generated by the main dryer unit 30' to be ventilated through the ventilating slots 16' and for allowing excessive heat to be dissipated from the ventilating slots 16'.

The engagement arrangement 11' of the nozzle body 1' contains a plurality of elongated engaging grooves 111' spacedly and circumferentially formed on the first end portion 12' of the nozzle body 1' wherein each of the engaging grooves 111' is arranged to engage with the air outlet 31' of the main dryer unit 30' so as to attach the nozzle 40' onto the main dryer unit 30'.

In this second preferred embodiment, the rotational body 2' is integrally extended from the nozzle body 1'. However, the rotational body 2' and the nozzle body 1' may be separate components. In such a case, the rotational body 2' may be attached onto the second end portion 13' of the nozzle body 1'.

The nozzle 40' further comprises an auxiliary air nozzle 41' selectively supported by the nozzle body 1' and is arranged to extend into the air-flowing channel 22' of the rotational body 2', wherein the air flowing into the air-flowing channel 22' is arranged to reach an exterior of the nozzle 40' through the auxiliary air nozzle 41' and the corresponding air outlets 21'.

More specifically, the auxiliary air nozzle 41' comprises a nozzle frame 411' having a plurality of nozzle outlets 412' spacedly formed on the nozzle frame 411' for allowing air flowing in the air-flowing channel 22' to reach the corresponding air outlets 21' through the nozzle outlets 412'. The nozzle frame 411' comprises a plurality of elongated frame members 4111' inclinedly and spacedly extended in the air-flowing channel 22' of the rotational body 2', and a plurality of air guiding rings 4112' transversely mounted between the elongated frame members 4111' to define the nozzle outlets 412' at spaces between the elongated frame members 4111' and the corresponding air guiding rings 4112'. Thus, the air flowing into the air-flowing channel 22' can reach an exterior of the rotational body 2' through the nozzle outlets 412' and the air outlets 21' which are in close proximity to the nozzle outlets 412'.

Moreover, the nozzle frame 411' further comprises an end cap 4113' formed at a distal end thereof for substantially preventing air from passing through the auxiliary air nozzle 41' in an axial direction thereof. In other words, all the air flowing through the nozzle frame 411' will exit the nozzle frame 411' through the nozzle outlets 412. The end cap 4113' has a through hole 4114' formed thereon for allowing a small amount of air to pass therethrough for ventilation purpose.

In this second preferred embodiment, the diameter of each of the air guiding rings 4112' is gradually decreasing from near the nozzle body 1' to a distal end of the nozzle frame 411' along a longitudinal axis of the auxiliary air nozzle 41' so as to constitute a truncated cone shape (i.e. tapered shape) of the auxiliary air nozzle 41'. This truncated cone shape corresponds to that of the rotational body 2' so that the auxiliary air nozzle 41' is capable of receiving into the rotational body 2'. The auxiliary air nozzle 41' is arranged to allow the air flowing into the air-flowing channel 22' to be evenly blown out through the air outlets 21'.

Furthermore, the auxiliary air nozzle 41' is arranged to be fittedly received in the rotational body 2'. In other words, and cross sectional shape of the auxiliary air nozzle 41' is substantially the same as that of the rotational body 2' so that when the auxiliary air nozzle 41' is received in the rotational body 2', a substantial amount of air is blocked by the end cap 4113' (except for a small amount of air passing through the through hole 4114') and is guided to flow out of the rotational body 2' through the nozzle outlets 412' and the corresponding air outlets 21' (i.e. those air outlets 21' overlapping on the auxiliary air nozzle 41'). In this second preferred embodiment, a longitudinal length of the auxiliary air nozzle 41' is smaller than that of the rotational body 2'.

The operation of the present invention is as follows: the user may choose if he or she wants to attach the auxiliary air nozzle 41' into the rotational body 2' and the nozzle body 1'. When the auxiliary air nozzle 41' is not mounted into the rotational body 2' and the nozzle body 1', air generated by the main dryer unit 30' is arranged to be blown out of the nozzle 40' primarily through the axial outlet 24' and secondarily through the air outlets 21'.

On the other hand, when the auxiliary air nozzle 41' is mounted in the air-flowing channel 22', the rotational body 2' is adapted for setting curling hair winded on the rotational body 2'. Because of the presence of the auxiliary air nozzle 41', the flow rate and flow volume of the air flowing out of air outlets 21' are designed such that more air are blown out of the rotational body 2' through the air outlets 21' which are overlapping on the nozzle outlets 412' (i.e. in close proximity to the nozzle body 1'). Since the end cap 4113' blocks a vast majority of air flowing to the axial outlet 24', the air will primarily flow out of the auxiliary air nozzle 41' through the nozzle outlets 412' and the air outlets 21' which are in close proximity to the nozzle outlet 412'. The flow volume and the flow rate of the air gradually decrease along the longitudinal axis of the rotational body 2'. This configuration is extremely suitable for those who wish to curl their hair.

The present invention, while illustrated and described in terms of a preferred embodiment and several alternatives, is not limited to the particular description contained in this specification. Additional alternative or equivalent components could be used to practice the present invention.

What is claimed is:

1. A nozzle for a main dryer unit having a dryer outlet, comprising:

a nozzle body having a first end portion, a second end portion, and an engagement structure provided on said first end portion and is arranged for connecting to said air outlet of the hair dryer; and a rotational body having an air-flowing channel longitudinally extended along an axis of said rotational body, an outer rotational surface, a plurality of through air outlets provided on said outer rotational surface and is communicated with said air-flowing channel, and an axial outlet formed at a distal end of said rotational body, wherein said rotational body is provided at said second end portion of said nozzle body for allowing hair to be curled on said rotational surface and dried by air blowing out of said air outlets so as to form a predetermined curling style for said hair, wherein said nozzle body is circular in cross sectional shape and is connected between said main dryer unit and said rotational body, wherein said rotational body is extended from said second end portion of said nozzle body and is adapted for being securely supported by said main dryer unit through said engagement structure, wherein said rotational body has a circular cross sectional shape and has a diameter gradually decreasing from said nozzle body toward a distal end of said rotational body so as to constitute a truncated cone shape of said rotational body, wherein said air outlets are spacedly and evenly provided on said rotational surface, wherein each of said air outlets is circular in shape and that said air from said air-flowing channel is guided to flow through said air outlets at a direction which is perpendicular to said circular opening of said air outlet, wherein a largest diameter of said rotational body is smaller than a diameter of said second end portion of said nozzle body to define a shoulder between said rotational body and said nozzle body, wherein said nozzle body further has a plurality of through ventilating slots spacedly formed on said shoulder of said nozzle body for allowing ventilation and heat dissipation, wherein said engagement arrangement of said nozzle body contains a plurality of elongated engaging grooves spacedly and circumferentially formed on said first end portion of said nozzle body wherein each of said engaging grooves is adapted for engaging with said air outlet of said main dryer unit so as to attach said nozzle onto said main dryer unit, wherein said nozzle further comprises an auxiliary air nozzle supported by said nozzle body and is arranged to extend into said air-flowing channel of said rotational body, wherein said air flowing into said air-flowing channel is arranged to reach an exterior of said nozzle through said auxiliary air nozzle and said air outlets which are in overlappedly positioned on said auxiliary air nozzle, wherein said auxiliary air nozzle comprises a nozzle frame having a plurality of nozzle outlets spacedly formed on said nozzle frame for allowing air flowing in said air-flowing channel to reach said air outlets through said nozzle outlets, wherein said nozzle frame comprises a plurality of elongated frame members inclinedly and spacedly extended in said air-flowing channel of said rotational body, a plurality of air guiding rings transversely mounted between said elongated frame members so as to define said nozzle outlets at spaces between said elongated frame members and said corresponding air guiding rings, and an end cap formed at a distal end of said nozzle frame for guiding air passing through said nozzle frame to exit said nozzle frame through said nozzle outlets, wherein said end cap has a through hole for ventilation.

2. The nozzle, as recited in claim 1, wherein a diameter of each of said air guiding rings is gradually decreasing from said nozzle body to a distal end of said auxiliary air nozzle along a longitudinal axis of said auxiliary air nozzle so as to constitute a corresponding truncated cone shape of said auxiliary air nozzle, wherein said auxiliary air nozzle is shaped and sized to be fittedly receive in said rotational body.

3. A hair dryer, comprising:

a main dryer unit having a dryer outlet; and a nozzle which is mounted on said main dryer unit, and comprises:

a nozzle body having a first end portion, a second end portion, and an engagement structure provided on said first end portion and is arranged for connecting to said air outlet of the hair dryer; and a rotational body having an air-flowing channel longitudinally extended along an axis of said rotational body, an outer rotational surface, a plurality of through air outlets provided on said outer rotational surface and is communicated with said air-flowing channel, and an axial outlet formed at a distal end of said rotational body, wherein said rotational body is mounted at said second end portion of said nozzle body for allowing hair to be curled on said rotational surface and dried by air blowing out of said air outlets so as to form a predetermined curling style for said hair, wherein said nozzle body is circular in cross sectional shape and is connected between said main dryer unit and said rotational body, wherein said rotational body is extended from said second end portion of said nozzle body and is securely supported by said nozzle body and said main dryer unit through said engagement structure, wherein said rotational body has a circular cross sectional shape and has a diameter gradually decreasing from said nozzle body toward a distal end of said rotational body so as to constitute a truncated cone shape of said rotational body, wherein said air outlets are spacedly and evenly provided on said rotational surface, wherein each of said air outlets is circular in shape and that said air from said air-flowing channel is guided to flow through said air outlets at a direction which is perpendicular to said circular opening of said air outlet, wherein a largest diameter of said rotational body is smaller than a diameter of said second end portion of said nozzle body to define a shoulder between said rotational body and said nozzle body, wherein said nozzle body further has a plurality of through ventilating slots spacedly formed on said shoulder of said nozzle body for allowing ventilation and heat dissipation, wherein said nozzle further comprises an auxiliary air nozzle supported by said nozzle body and is arranged to extend into said air-flowing channel of said rotational body, wherein said air flowing into said air-flowing channel is arranged to reach an exterior of said nozzle through said auxiliary air nozzle and said air outlets which are in overlappedly positioned on said auxiliary air nozzle, wherein said auxiliary air nozzle comprises a nozzle frame having a plurality of nozzle outlets spacedly formed on said nozzle frame for allowing air flowing in said air-flowing channel to reach said air outlets through said nozzle outlets, wherein said nozzle frame comprises a plurality of elongated frame members inclinedly and spacedly extended in said air-flowing channel of said rotational body, a plurality of air guiding rings transversely mounted between said elongated frame members so as to define said nozzle outlets at spaces between said elongated frame members and said corresponding air guiding rings, and an end cap formed at a distal end of said nozzle frame for guiding air passing through said nozzle frame to exit said nozzle frame through said nozzle outlets, wherein said end cap has a through hole for ventilation.

4. The hair dryer, as recited in claim 3, wherein a diameter of each of said air guiding rings is gradually decreasing from said nozzle body to a distal end of said auxiliary air nozzle along a longitudinal axis of said auxiliary air nozzle so as to constitute a corresponding truncated cone shape of said auxiliary air nozzle, wherein said auxiliary air nozzle is shaped and sized to be fittedly receive in said rotational body.

* * * * *